US007997993B1

(12) United States Patent
Matthews

(10) Patent No.: US 7,997,993 B1
(45) Date of Patent: Aug. 16, 2011

(54) GOLF RESISTANCE/STRETCHING AID SYSTEM

(76) Inventor: Blane A. Matthews, Tampa, FL (US)

( * ) Notice: Subject to any disclaimer, the term of this patent is extended or adjusted under 35 U.S.C. 154(b) by 0 days.

(21) Appl. No.: 12/806,030

(22) Filed: Aug. 4, 2010

(51) Int. Cl.
*A63B 69/36* (2006.01)
*A63B 21/04* (2006.01)

(52) U.S. Cl. ..... 473/229; 482/129

(58) Field of Classification Search ..... 473/213–229, 473/257, 258; 482/109, 121–130, 904
See application file for complete search history.

(56) References Cited

U.S. PATENT DOCUMENTS

| | | | | |
|---|---|---|---|---|
| 4,328,964 | A * | 5/1982 | Walls | 482/129 |
| 5,524,893 | A * | 6/1996 | McGinnis et al. | 473/229 |
| 6,558,302 | B2 * | 5/2003 | Cluff | 482/129 |
| 7,074,131 | B1 * | 7/2006 | Renaud | 473/219 |
| 7,364,516 | B2 * | 4/2008 | Kim | 473/409 |

* cited by examiner

*Primary Examiner* — Nini Legesse

(57) ABSTRACT

A central junction in a generally Y-shaped configuration has a primary leg and first and second secondary legs with a recess formed in each leg. First and second elastic cords have interior and exterior ends. An essentially rigid shaft has an elastomeric grip on its interior end. First and second clips each have a base with a recess and a resilient finger with a free end. Two connectors are located between the interior ends of the cords and the recesses of the secondary legs. Two connectors are located between the exterior ends of the cords and the recesses of the clips. One connector is located between the exterior end of the shaft and recess of the primary leg.

6 Claims, 2 Drawing Sheets

GOLF RESISTANCE/STRETCHING AID SYSTEM

BACKGROUND OF THE INVENTION

1. Field of the Invention

The present invention relates to a golf resistance/stretching aid system and more particularly pertains to assisting a golfer in swing improvement through resistance training and muscle stretching, the resistance training and muscle stretching being done in a safe, convenient and economical manner.

2. Description of the Prior Art

The use of golf training aid systems of known designs and configurations is known in the prior art. More specifically, golf training aid systems of known designs and configurations previously devised and utilized for the purpose of improving a golfer's swing are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, they do not describe a golf resistance/stretching aid system that allows assisting a golfer in swing improvement through resistance training and muscle stretching, the resistance training and muscle stretching being done in a safe, convenient and economical manner.

In this respect, the golf resistance/stretching aid system according to the present invention substantially departs from the conventional concepts and designs of the prior art, and in doing so provides an apparatus primarily developed for the purpose of assisting a golfer in swing improvement through resistance training and muscle stretching, the resistance training and muscle stretching being done in a safe, convenient and economical manner.

Therefore, it can be appreciated that there exists a continuing need for a new and improved golf resistance/stretching aid system which can be used for assisting a golfer in swing improvement through resistance training and muscle stretching, the resistance training and muscle stretching being done in a safe, convenient and economical manner. In this regard, the present invention substantially fulfills this need.

SUMMARY OF THE INVENTION

In view of the foregoing disadvantages inherent in the known types of golf training aid systems of known designs and configurations now present in the prior art, the present invention provides an improved golf resistance/stretching aid system. As such, the general purpose of the present invention, which will be described subsequently in greater detail, is to provide a new and improved golf resistance/stretching aid system and method which has all the advantages of the prior art and none of the disadvantages.

To attain this, the present invention essentially comprises First provided is a central junction in a generally Y-shaped configuration. The junction has a primary leg. The junction also has a first secondary leg and a similarly configured second secondary leg. The primary leg and the first and second secondary legs are positionable in a common vertical plane. Each leg has a free end formed with a recess.

A right angle is formed between the secondary legs. Two equal obtuse angles are formed between the primary leg and the first and second secondary legs.

Next provided are a first elastic cord and a similarly configured second elastic cord. Each of the cords is fabricated of a hollow medical tubing having an exterior diameter of 0.5 inch plus or minus 10 percent and an interior diameter of 0.3 inch plus or minus 10 percent. Each cord has an interior end and an exterior end. The ends are separated by an unstretched length of between 30 and 38 inches. Each cord is adapted to be stretched during use by between 30 and 40 percent of its unstretched length.

A shaft fabricated of an essentially rigid material is next provided. The shaft has an interior end and an exterior end. The ends are separated by a length of between 18 and 22 inches. An elastomeric grip is removably received upon the interior end of the shaft. The grip has an exterior surface with contours facilitating receipt and proper positioning of a user's hand on the grip with the primary leg and the first and secondary legs in the common vertical plane.

Next, a first clip and a similarly configured second clip are provided. Each clip has a base and a resilient finger with a free end. The free end is adapted to move between a closed position in contact with the base and an open position out of contact with the base. Each base has a recess.

Lastly, two connectors located between the interior ends of the cords and the recesses of the secondary legs of the junction are provided. Two connectors located between the exterior ends of the cords and the recesses of the clips are also provided. One connector located between the exterior end of the shaft and recess of the primary leg of the junction is provided. Each connector has a male member with a projection formed at the ends of the cords and at the exterior end of the shaft. Each connector has a female member with a hole formed at the recesses of the primary and secondary legs of the junction and the clips. The connectors are adapted to connect by inserting the male member into the female member and rotating the male member. The connectors are adapted to disconnect by counter-rotating the male member and withdrawing the male member from the female member.

The system is adapted to be attached to an object such as a golf cart through the clips. Alternatively, the system is adapted to be attached around an object such as a tree through the clips. In this manner, when attached, the shaft is adapted to be grasped by a user holding the grip and the shaft then moved in a golfing swing for resistance stretching and muscle stretching purposes.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golf resistance/stretching aid system which has all of the advantages of the prior art golf training aid systems of known designs and configurations and none of the disadvantages.

It is another object of the present invention to provide a new and improved golf resistance/stretching aid system which may be easily and efficiently manufactured and marketed.

It is further object of the present invention to provide a new and improved golf resistance/stretching aid system which is of durable and reliable constructions.

An even further object of the present invention is to provide a new and improved golf resistance/stretching aid system which is susceptible of a low cost of manufacture with regard to both materials and labor, and which accordingly is then susceptible of low prices of sale to the consuming public, thereby making such golf resistance/stretching aid system economically available to the buying public.

Even still another object of the present invention is to provide a golf resistance/stretching aid system for assisting a golfer in swing improvement through resistance training and muscle stretching, the resistance training and muscle stretching being done in a safe, convenient and economical manner.

Lastly, it is an object of the present invention to provide a new and improved golf resistance/stretching aid system having a central junction in a generally Y-shaped configuration with a primary leg and first and second secondary legs with a recess formed in each leg. First and second elastic cords have interior and exterior ends. An essentially rigid shaft has an elastomeric grip on its interior end. First and second clips each have a base with a recess and a resilient finger with a free end. Two connectors are located between the interior ends of the cords and the recesses of the secondary legs. Two connectors are located between the exterior ends of the cords and the recesses of the clips. One connector is located between the exterior end of the shaft and recess of the primary leg.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
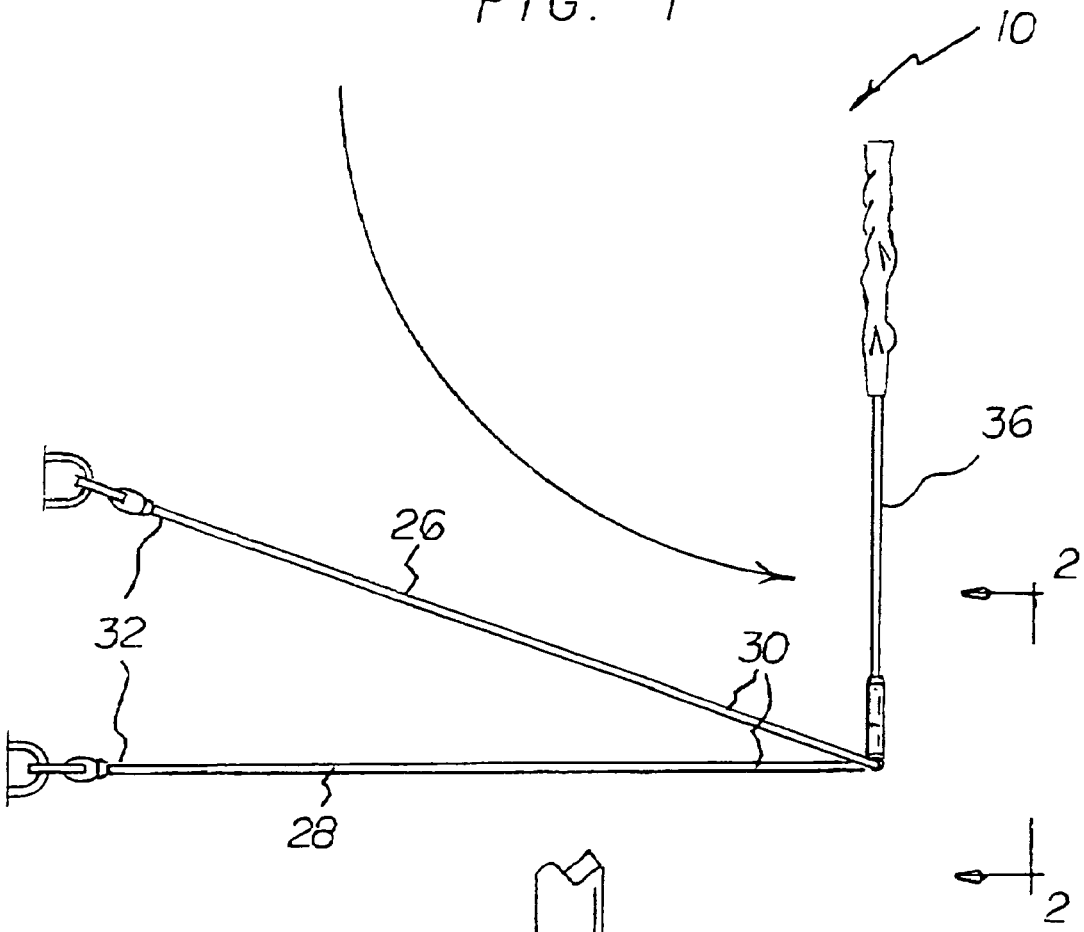
FIG. 1 is a plan view of a golf resistance/stretching aid system constructed in accordance with the principles of the present invention.
Figure 2:
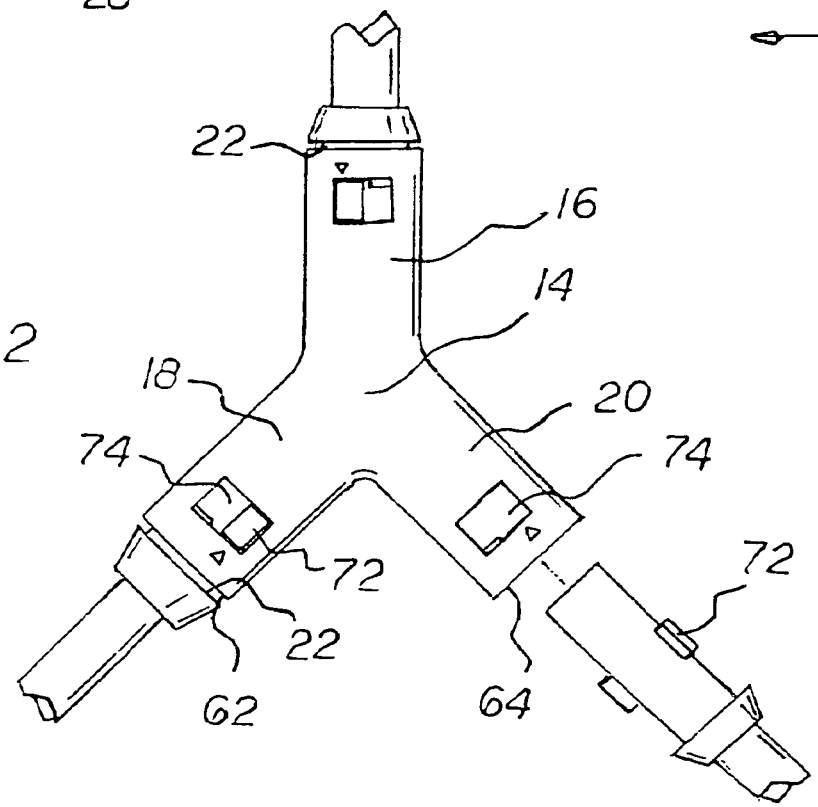
FIG. 2 is an enlarged side elevational view taken along line 2-2 of FIG. 1.
Figure 3:
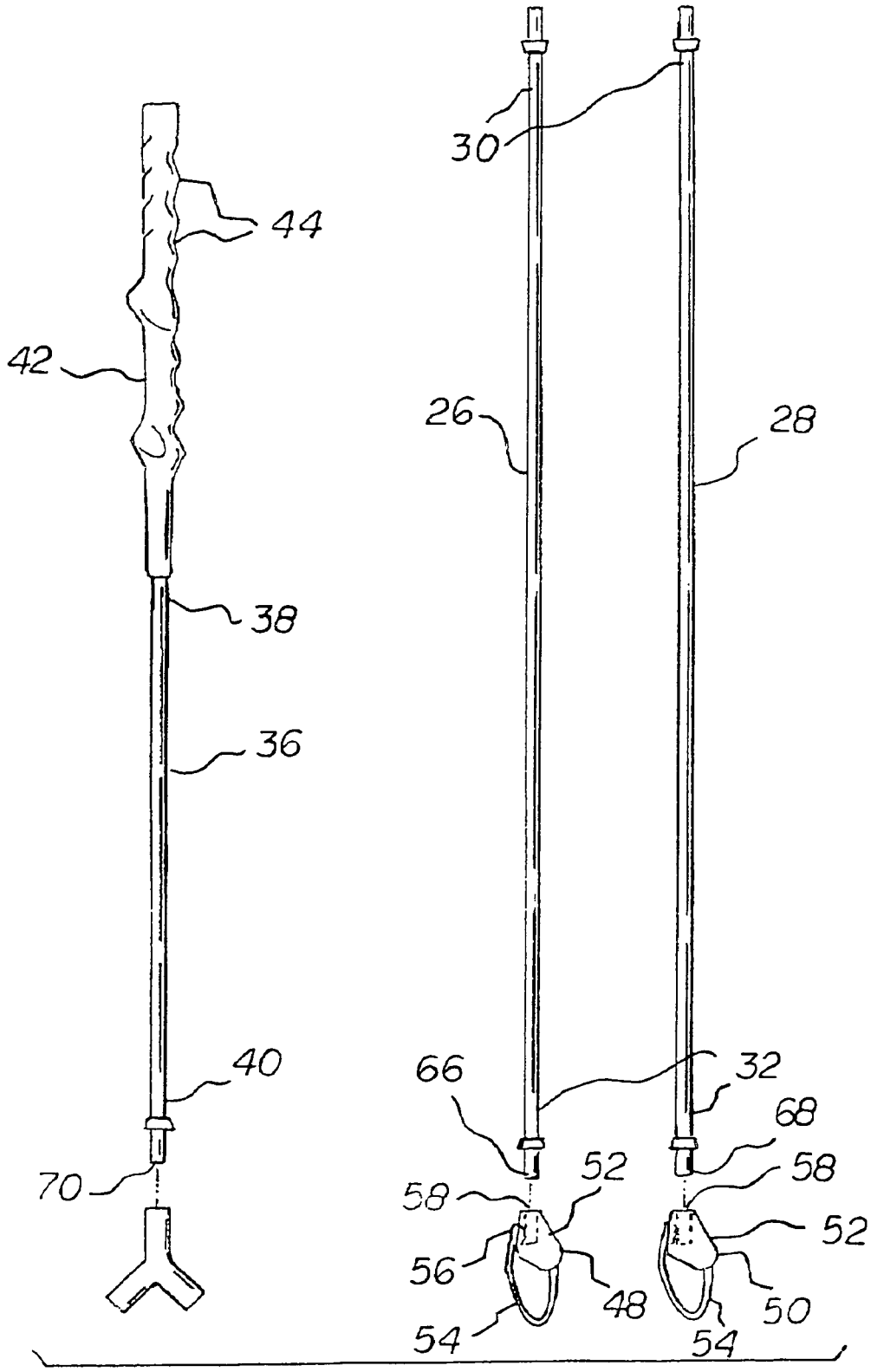
FIG. 3 is a plan view of the six components of the system of the present invention.

With reference now to the drawings, and in particular to FIG. 1 thereof, the preferred embodiment of the new and improved golf resistance/stretching aid system embodying the principles and concepts of the present invention and generally designated by the reference numeral 10 will be described.

The present invention, the golf resistance/stretching aid system 10 is comprised of a plurality of components. Such components in their broadest context include a junction, two cords, two clips and a shaft. Such components are individually configured and correlated with respect to each other so as to attain the desired objective.

First provided is a central junction 14 in a generally Y-shaped configuration. The junction has a primary leg 16. The junction also has a first secondary leg 18 and a similarly configured second secondary leg 20. The primary leg and the first and second secondary legs are positionable in a common vertical plane. Each leg has a free end formed with a recess 22. A right angle is formed between the secondary legs. Two equal obtuse angles are formed between the primary leg and the first and second secondary legs.

Next provided are a first elastic cord 26 and a similarly configured second elastic cord 28. Each of the cords is fabricated of a hollow medical tubing having an exterior diameter of 0.5 inch plus or minus 10 percent and an interior diameter of 0.3 inch plus or minus 10 percent. Each cord has an interior end 30 and an exterior end 32. The ends are separated by an unstretched length of between 30 and 38 inches. Each cord is adapted to be stretched during use by between 30 and 40 percent of its unstretched length.

A shaft 36 fabricated of an essentially rigid material is next provided. The shaft has an interior end 38 and an exterior end 40. The ends are separated by a length of between 18 and 22 inches. An elastomeric grip 42 is removably received upon the interior end of the shaft. The grip has an exterior surface with contours 44 facilitating receipt and proper positioning of a user's hand on the grip with the primary leg and the first and secondary legs in the common vertical plane.

Next, a first clip 48 and a similarly configured second clip 50 are provided. Each clip has a base 52 and a resilient finger 54 with a free end 56. The free end is adapted to move between a closed position in contact with the base and an open position out of contact with the base. Each base has a recess 58.

Lastly, two connectors 62, 64 located between the interior ends of the cords and the recesses of the secondary legs of the junction are provided. Two connectors 66, 68 located between the exterior ends of the cords and the recesses of the clips are also provided. One connector 70 located between the exterior end of the shaft and recess of the primary leg of the junction is provided. Each connector has a male member with a projection 72 formed at the ends of the cords and at the exterior end of the shaft. Each connector has a female member with a hole 74 formed at the recesses of the primary and secondary legs of the junction and the clips. The connectors are adapted to connect by inserting the male member into the female member and rotating the male member. The connectors are adapted to disconnect by counter-rotating the male member and withdrawing the male member from the female member.

The system is adapted to be attached to an object such as a golf cart through the clips. Alternatively, the system is adapted to be attached around an object such as a tree through the clips. In this manner, when attached, the shaft is adapted to be grasped by a user holding the grip and the shaft then moved in a golfing swing for resistance training and muscle stretching purposes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf resistance/stretching aid system comprising:

a central junction in a generally Y-shaped configuration with a primary leg and first and second secondary legs, each leg being formed with a recess;

first and second elastic cords with interior and exterior ends;

an essentially rigid shaft with interior and exterior ends and an elastomeric grip on the interior end of the shaft;

first and second clip, each clip having a base with a recess, each clip having a resilient finger with a free end; and two connectors located between the interior ends of the cords and the recesses of the secondary legs, two connectors located between the exterior ends of the cords and the recesses of the clips, one connector located between the exterior end of the shaft and recess of the primary leg.

2. The system as set forth in claim 1 wherein each connector has a male member with a projection formed at the ends of the cords and at the exterior end of the shaft, and wherein each connector has a female member with a hole formed in the recesses of the clips and in the recesses of the primary and secondary legs of the junction, and wherein the connectors are adapted to connect by inserting a male member into a female member and rotating the male member, and wherein the connectors are adapted to disconnect by counter-rotating a male member and withdrawing the male member from the female member.

3. The system as set forth in claim 2 wherein the system is adapted to be attached to an object such as a golf cart through the clips, and wherein the system is alternately adapted to be attached around an object such as a tree through the clips, whereby when attached, the shaft is adapted to be held by a user at the grip and the shaft then moved in a golfing swing for resistance training and muscle stretching purposes.

4. The system as set forth in claim 1 wherein each cord is fabricated of a hollow medical tubing having an exterior diameter and an interior diameter, each cord having an interior end and an exterior end separated by an unstretched length of between 30 and 38 inches, each cord adapted to be stretched during use by between 30 and 40 percent of its unstretched length.

5. The system as set forth in claim 1 wherein the junction includes a right angle formed between the secondary legs, wherein the junction also includes two equal obtuse angles formed between the primary leg and the first and second secondary legs.

6. A golf resistance/stretching aid system (10) for assisting a golfer in swing improvement through resistance training and muscle stretching, the system comprising, in combination:

a central junction (14) in a generally Y-shaped configuration, the junction having a primary leg (16) and a first secondary leg (18) and a similarly configured second secondary leg (20), the primary leg and the first and second secondary legs being positionable in a common vertical plane, each leg having a free end formed with a recess (22), a right angle formed between the secondary legs, two equal obtuse angles formed between the primary leg and the first and second legs;

a first elastic cord (26) and a similarly configured second elastic cord (28), each cord being fabricated of a hollow medical tubing having an exterior diameter of 0.5 inch plus or minus 10 percent and an interior diameter of 0.3 inch plus or minus 10 percent, each cord having an interior end (30) and an exterior end (32) separated by an unstretched length of between 30 and 38 inches, the cord adapted to be stretched during use by between 30 and 40 percent of its unstretched length;

a shaft (36) fabricated of an essentially rigid material with an interior end (38) and an exterior end (40) separated by a length of between 18 and 22 inches, an elastomeric grip (42) removably received upon the interior end of the shaft, the grip having an exterior surface with contours (44) facilitating receipt and proper positioning of a user's hand on the grip with the primary leg and the first and secondary legs in the common vertical plane;

a first clip (48) and a similarly configured second clip (50), each clip having a base (52) and a resilient finger (54) with a free end (56), the free end adapted to move between a closed position in contact with the base and an open position out of contact with the base, each base having a recess (58); and two connectors (62)(64) located between the interior ends of the cords and the recesses of the secondary legs of the junction, two connectors (66)(68) located between the exterior ends of the cords and the recesses of the clips, one connector (70) located and between the exterior end of the shaft and recess of the primary leg of the junction, each connector having a male member with a projection (72) formed at the ends of the cords and at the exterior end of the shaft, each connector having a female member with a hole (74) formed at the recesses of the primary and secondary legs of the junction and the clips, the connectors adapted to connect by inserting the male member into the female member and rotating the male member, the connectors adapted to disconnect by counter-rotating the male member and withdrawing male member from the female member;

the system adapted to be attached to an object such as a golf cart through the clips, the system alternately adapted to be attached around an object such as a tree through the clips, whereby when attached, the shaft is adapted to be grasped by a user holding the grip and the shaft then moved in a golfing swing for resistance training and muscle stretching purposes.

* * * * *